US009873440B2

(12) United States Patent
Gaertner et al.

(10) Patent No.: US 9,873,440 B2
(45) Date of Patent: Jan. 23, 2018

(54) TRANSPORTATION MEANS WITH WATER SUPPLY DEVICE

(71) Applicant: SIEMENS AKTIENGESELLSCHAFT, Munich (DE)

(72) Inventors: Ralph Gaertner, Brueggen (DE); Christian Schneider, Dinslaken (DE)

(73) Assignee: Siemens Aktiengesellschaft, Munich (DE)

( * ) Notice: Subject to any disclaimer, the term of this patent is extended or adjusted under 35 U.S.C. 154(b) by 413 days.

(21) Appl. No.: 14/411,759

(22) PCT Filed: May 22, 2013

(86) PCT No.: PCT/EP2013/060497

§ 371 (c)(1),
(2) Date: Dec. 29, 2014

(87) PCT Pub. No.: WO2014/000986

PCT Pub. Date: Jan. 3, 2014

(65) Prior Publication Data

US 2015/0166077 A1 Jun. 18, 2015

(30) Foreign Application Priority Data

Jun. 28, 2012 (DE) ..... 10 2012 211 168

(51) Int. Cl.
*B67D 7/72* (2010.01)
*B65D 88/74* (2006.01)
(Continued)

(52) U.S. Cl.
CPC ..... *B61D 5/04* (2013.01); *B61D 5/00* (2013.01); *B61D 35/00* (2013.01); *Y10T 137/6858* (2015.04)

(58) Field of Classification Search
CPC ..... Y10T 137/3127; Y10T 137/6858; B61D 35/00; B61D 5/04; B61D 5/00
(Continued)

(56) References Cited

U.S. PATENT DOCUMENTS 4,142,262 A * 3/1979 Hamilton ..... E03D 1/22 4/354
4,214,324 A * 7/1980 Kemper ..... B61D 35/007 241/46.01
(Continued)

FOREIGN PATENT DOCUMENTS

DE 10308498 A1 9/2004
DE 202008016607 U1 3/2009
(Continued)

OTHER PUBLICATIONS

Machine translation of WO97/46435, Siemens SGP VERKENRSTECH GMBH, Process and Device for Partially Emptying in a controlled manner a Waste Water Container in a Vehicle, in particular a Railway Vehicle, Dec. 11, 1997, [Retrieved on Mar. 18, 2017] Retrieved from the internet; http://www.Espacenet.com.*

*Primary Examiner* — Craig J Price
(74) *Attorney, Agent, or Firm* — Laurence Greenberg; Werner Stemer; Ralph Locher

(57) ABSTRACT

A transportation device, such as a rail vehicle, has a water supply device with a freshwater tank, at least one used water device connected to the freshwater tank and a collecting container connected to the used water device. The collecting container collects and stores used water which comes from the used water device The water supply device includes a control device which, by way of at least one control signal, can predefine one of at least two different operating modes, specifically a normal operating mode and an economy operating mode in which, compared to the normal operating mode, at least one operational resource which is necessary
(Continued)

to operate the water supply device is consumed to a lesser extent than in the normal operating mode.

12 Claims, 6 Drawing Sheets

(51) Int. Cl.
*B61D 35/00* (2006.01)
*B61D 5/00* (2006.01)

(58) Field of Classification Search
USPC ..... 137/209, 565.18; 4/415, 340, 665
See application file for complete search history.

(56) References Cited

U.S. PATENT DOCUMENTS 4,407,025 A * 10/1983 Hennessy ..... E03D 3/10 4/321
5,056,544 A * 10/1991 Stevens ..... B60R 15/00 134/103.2
6,226,807 B1 5/2001 Rozenblatt et al.
8,602,353 B2 12/2013 Lindauer et al.
2010/0299822 A1* 12/2010 Vargas ..... E03D 1/08 4/354
2011/0004990 A1* 1/2011 Leitao ..... E03D 5/10 4/328
2012/0222758 A1 9/2012 Gaertner et al.
2015/0033463 A1* 2/2015 Roeser ..... E03D 3/10 4/407
2015/0252556 A1* 9/2015 Hall ..... E03D 5/012 4/319

FOREIGN PATENT DOCUMENTS

DE 102009021970 A1 11/2010
EP 1057943 A2 12/2000
WO 9746435 A1 12/1997
WO 2011051345 A1 5/2011

* cited by examiner

TRANSPORTATION MEANS WITH WATER SUPPLY DEVICE

BACKGROUND OF THE INVENTION

Field of the Invention

The invention relates to a transportation means, especially a railway vehicle, with a water supply device that comprises a fresh water tank, at least one water usage device connected to the fresh water tank and a collection container connected to the water usage device for collection and storage of the used water coming from the water usage device (also called waste water below).

Water supply devices for currently known railway vehicles consistently operate with the same control parameters. This means that the consumption of resources when operating the water supply device is always the same.

BRIEF SUMMARY OF THE INVENTION

The object of the invention is to specify a transportation means with an improved water supply device.

This object is achieved according to the invention by a transportation means with the features as claimed. Advantageous embodiments of the transportation means according to the invention are specified in the dependent claims.

Accordingly, it is provided according to the invention that the water supply device comprises a control device that can set one of at least two different operating modes of the water supply device by means of at least one control signal, the modes being a normal operating mode and a saving operating mode, in which compared to the normal operating mode at least one operating resource necessary for operating the water supply device is consumed to a lesser extent than in the normal operating mode.

A significant advantage of the transportation means according to the invention can be seen to be that in the case of a lack of resources or an expected lack of resources the water supply device can be changed from a normal operating mode to a saving operating mode, in which all or only the operating resources affected by a shortage are used to a lesser extent or less than in the normal operating mode. In contrast to previously known transportation means, in the case of the transportation means according to the invention it is thus possible to extend the period of use of the water supply device if it can be seen that in the case of further operation of the water supply device in the normal operating mode its continued use would no longer be possible for the distance still to be covered by the transportation means before reaching the next stopping or service point. A failure of the water supply device while the transportation means is travelling can thus be completely prevented in many cases, but it can be at least significantly delayed so that the lack of resources is either not noticed by the passengers at all or is not considered by them to be problematic because of the only short remaining travelling time.

In order to ensure timely adjustment of the water supply device, it is seen as advantageous if the control device is connected to a measurement sensor with which it monitors the supply of resources of the at least one operating resource that is necessary for the operation of the water supply device and changes the water supply device from the normal operating mode into the saving operating mode if the supply of resources reaches or falls below a minimum threshold.

In order to ensure an adequate flow of water from the fresh water container towards the water usage device and from there towards the collection container during the use of the water supply device, it is viewed as advantageous if the water supply device comprises a compressed air device that produces compressed air as an operating resource and whose pressure forces the water from the fresh water tank towards the water usage device and/or from the water usage device towards the collection container.

In the case of a water supply device fitted with a compressed air device it is considered to be advantageous if a control valve is connected to the control device with which the working pressure acting on the fresh water tank and thus the flow of compressed air can be adjusted, and the control device is configured such that using the control valve it reduces the working pressure from a specified normal pressure to a lower saving pressure if the supply of resources of compressed air reaches or falls below a specified minimum threshold.

With a view to the monitoring of the supply of resources of compressed air it is of advantage if the water supply device comprises a pressure sensor connected to the control device, with which the pressure in a pressure container of the compressed air device is monitored. Preferably, the control device is configured such that it reduces the working pressure of the compressed air device from a specified normal pressure to a lower saving pressure if the pressure in the pressure container reaches or falls below a specified minimum pressure.

Additionally or alternatively to monitoring the compressed air device, monitoring of the water level of the fresh water tank can be carried out because the fresh water also forms an operating resource of the water supply device. In this respect, it is considered to be advantageous if the water supply device comprises a water level sensor connected to the control device, with which the available amount of fresh water in the fresh water tank is monitored, and the control device is configured such that it reduces the water consumption from a specified normal consumption to a lower saving consumption if the available amount of fresh water in the fresh water tank reaches or falls below a specified minimum value.

Water consumption regulation can be carried out particularly simply and thus advantageously if the water supply device comprises a control valve connected to the control device and acting on the flow of fresh water, whose valve opening time can be adjusted by the control device, and the control device is configured such that it reduces the valve opening time of the control valve per opening process from a specified normal opening time to a shorter saving opening time if the supply of resources of fresh water reaches or falls below a specified minimum threshold.

Alternatively or additionally to monitoring the amount of fresh water in the fresh water tank, monitoring of the waste water level in the collection container can be provided because the still recoverable amount of waste water also forms an operating resource of the water supply device. In this respect, it is considered to be advantageous if the water supply device comprises a water level sensor connected to the control device, with which the waste water accommodated in the collection container or the still recoverable amount of waste water is monitored, and the control device is configured such that it reduces the water consumption from a specified normal consumption to a lower saving consumption if the amount of waste water accommodated in the collection container reaches or exceeds a specified maximum value or the amount of waste water still recoverable in the collection container reaches or falls below a specified minimum value.

Particularly simple control of the flow of waste water into the collection container is possible if the water supply device comprises a control valve connected to the control device and acting on the flow of fresh water, whose valve opening time can be adjusted by the control device, and the control device is configured such that it reduces the valve opening time of the control valve per opening process from a specified normal opening time to a shorter saving opening time if the amount of waste water accommodated in the collection container reaches or exceeds a specified maximum value or the still recoverable amount of used water in the collection container reaches or falls below a specified minimum value.

Furthermore, the water supply device can also take into account when there is a lack of resources in the form of a power shortage. For such a configuration it is considered to be advantageous if the water supply device comprises an interface to a central vehicle control device of the railway vehicle and the control device of the water supply device is configured such that it produces a control signal to set the saving operating mode if the central vehicle control device indicates an existing or forthcoming limitation of the electrical resources available to the water supply device by means of a warning signal via the interface.

The water supply device can comprise e.g. a heating device for heating the fresh water tank, i.e. the water usage device, the space in which the water usage device is disposed and/or the collection container. Regarding the control of such a heating device, it is considered to be advantageous if the control device is configured such that it reduces the heating power from a specified normal consumption to a lower saving consumption if the warning signal is present at the interface to the vehicle control device.

The invention also provides a method for operating a water supply device that comprises a fresh water tank, at least one water usage device connected to the fresh water tank and a collection container connected to the water usage device for collecting and storing the used water coming from the water usage device in a transportation means, especially a railway vehicle.

According to the invention it is provided that, depending on the available resources, the water supply device will set one of at least two different operating modes by means of at least one control signal, said modes being a normal operating mode or a saving operating mode, in which compared to the normal operating mode at least one operating resource necessary for operating the water supply device is consumed to a lesser extent than in the normal operating mode.

With respect to the advantages of the method according to the invention, reference is made to the above embodiments in connection with the transportation means according to the invention, because the advantages of the method according to the invention essentially correspond to those of the transportation means according to the invention.

BRIEF DESCRIPTION OF THE SEVERAL VIEWS OF THE DRAWING

The invention is explained in detail below using exemplary embodiments; in the figures, by way of example

For clarity, the same reference characters are always used in the figures for similar or identical components.

DESCRIPTION OF THE INVENTION

Figure 1:
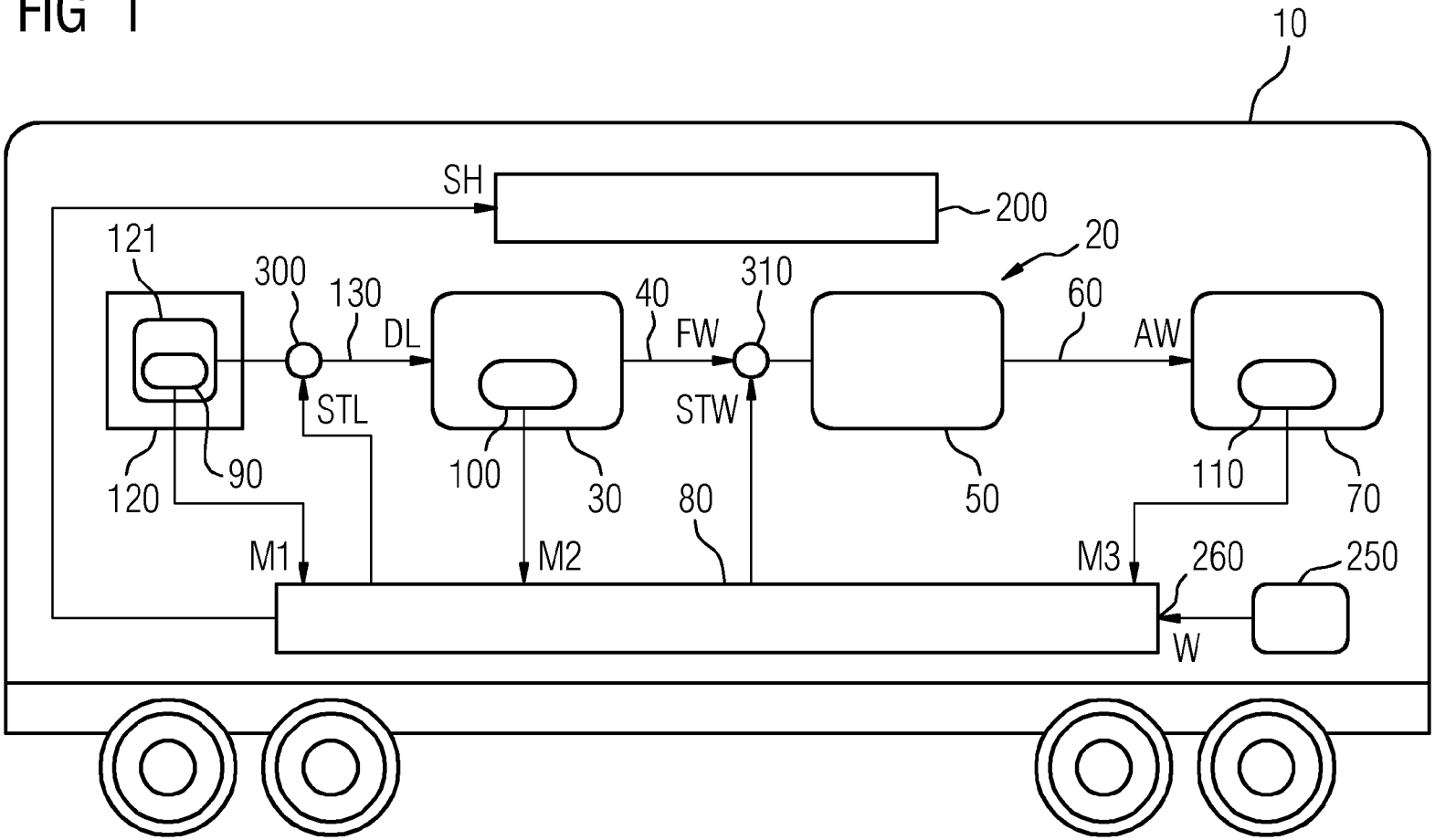
FIG. 1 shows a first exemplary embodiment of a transportation means according to the invention, which is equipped with a water supply device.

In FIG. 1 a railway vehicle 10 can be seen that is equipped with a water supply device 20. The water supply device 20 comprises a fresh water tank 30, which is connected by means of a fresh water line 40 to one or usually a plurality of water usage devices 50. The water used by the water usage device 50 is passed to a collection container 70 of the water supply device 20 as waste water AW by means of a waste water line 60.

The water supply device 20 is provided with a control device 80 that can set one of at least two different operating modes, i.e. a normal operating mode and a saving operating mode, in which compared to the normal operating mode at least one operating resource necessary for operating the water supply device 20 is used to a lesser extent than in the normal operating mode.

The control device 80 is connected to three measurement sensors in the case of the exemplary embodiment according to FIG. 1, namely a pressure sensor 90, a water level sensor 100 that measures the water level in the fresh water tank 30 and a water level sensor 110 that measures the water level in the collection container 70. The pressure sensor 90 and the two water level sensors 100 and 110 are connected to the control device 80 by means of measurement lines.

The pressure sensor 90 is disposed in the region of a compressed air device 120 of the water supply device 20 and is used to measure the respective pressure in a pressure container 121 of the compressed air device 120 and to transfer the corresponding measurement value M1 to the control device 80.

The water level sensor 100 is disposed in the region of the fresh water tank 30 and is used to transfer a measurement value M2 indicating the respective water level in the fresh water tank 30 to the control device 80.

The water level sensor 110 is mounted in the region of the collection container 70 and is used to measure the water level in the collection container 70 and to transfer the measurement value M3 indicating the respective water level to the control device 80.

As can be seen in FIG. 1, the compressed air device 120 is connected to the fresh water tank 30 by means of a compressed air line 130. The function of the compressed air device 120 is to force compressed air DL via the compressed air line 130 into the fresh water tank 30, so that fresh water FW flows out of the fresh water tank 30 with a certain pressure via the fresh water line 40 to the water usage device 50.

In FIG. 1 a heating device 200 can also be seen, which can be used to heat the fresh water tank 30, i.e. the water usage device 50, the space in which the water usage device 50 is disposed and/or the collection container 70. The heating device 200 is controlled by means of a control signal SH from the control device 80. The heating power that should be used for heating is specified to the heating device 200 by means of the control signal SH.

FIG. 1 also shows a central vehicle control device 250 that is connected to an interface 260 of the control device 80. By means of said interface 260 the central vehicle control device 250 can transfer a warning signal W to the control device 80, with which e.g. it can be indicated whether the electrical power resources in the railway vehicle are adequate or not.

If the central vehicle control device 250 e.g. determines that adequate electrical power resources are no longer available, then using the warning signal W it can be indicated to the control device 80 that the power consumption of the water supply device 20 should be reduced. Such a reduction of the power consumption is possible e.g. by the control device 80 reducing the power consumption of the heating device 200; for this purpose it can send a suitable control signal SH for reduction of the heating power to the heating device 200.

In FIG. 1 two control valves can also be seen, namely a compressed air valve 300 and a water valve 310. The compressed air valve 300 is mounted in the region of the compressed air line 130 and is used to control the flow of compressed air between the compressed air device 120 and the fresh water tank 30, whereby the water pressure with which the fresh water FW is forced out of the fresh water tank 30 into the fresh water line 40 is also directly determined. It is possible for the control device 80 to adjust the flow of water through the fresh water line 40 using the water valve 310.

The water supply device 20 according to FIG. 1 can e.g. be operated as follows:

1. Monitoring the Compressed Air Device 120:

The control device 80 preferably monitors the pressure in the pressure container 121 of the compressed air device 120 using the pressure sensor 90 by analyzing the measurement values M1 of the pressure sensor 90. If the control device 80, e.g. using the measurement value M1, determines that the pressure in the pressure container 121 of the compressed air device 120 is below a specified minimum pressure, then it can reduce the compressed air consumption of the water supply device 20, e.g. by using a control signal STL to adjust the compressed air valve 300 such that the working pressure acting on the fresh water tank 30 is reduced at the interface to the fresh water tank 30 from a usual normal pressure to a lower saving pressure.

2. Monitoring the Fresh Water Tank 30:

Additionally or alternatively, the control device 80 can monitor the water level in the fresh water tank 30 using the water level sensor 100 by analyzing the measurement value M2 of the water level sensor 100. If the control device 80 determines in the context of said analysis that the amount of fresh water available in the fresh water tank 30 is below a specified minimum value, then it can adjust the water valve 310 connected upstream of the water usage device 50 using a control signal STW and thus reduce the water consumption from a usual normal consumption to a lower saving consumption. Such a reduction can e.g. be carried out simply by reducing the flow of water through the water valve 310. Alternatively or additionally, it is possible to reduce the water consumption by reducing the valve opening time of the water valve 310 during the use of the water usage device 50 from a usual normal opening time to a shorter saving opening time. If the water usage device 50 is e.g. a flushing lavatory, then the flushing time can be reduced in the saving operating mode compared to the normal operating mode.

3. Monitoring the Collection Container 70:

Additionally or alternatively, the control device 80 can monitor the waste water level in the collection container 70 by analyzing the measurement signal M3 of the water level sensor 110. If in doing so the control device determines that the amount of waste water accommodated in the collection container 70 has reached or already exceeded a specified maximum value or that the still recoverable amount of waste water in the collection container has reached or fallen below a specified minimum value, then the control device 80 can reduce the water consumption and hence the further reception of waste water AW in the collection container 70 by either reducing the water flowing through the water valve 310 and/or reducing the working pressure acting on the fresh water tank 30 by means of the compressed air valve 300; the amount of fresh water FW flowing out of the fresh water tank 30 can be reduced with both measures.

4. Saving Mode in the Event of a Shortage of Electrical Power:

If the control device 80 receives a warning signal W from the central vehicle control device 250 indicating a shortage of electrical power resources, then the control device 80 can reduce the heating power of the heating device 200 by means of the control signal SH in order to reduce the power consumption of the water supply device 20.

Figure 2:
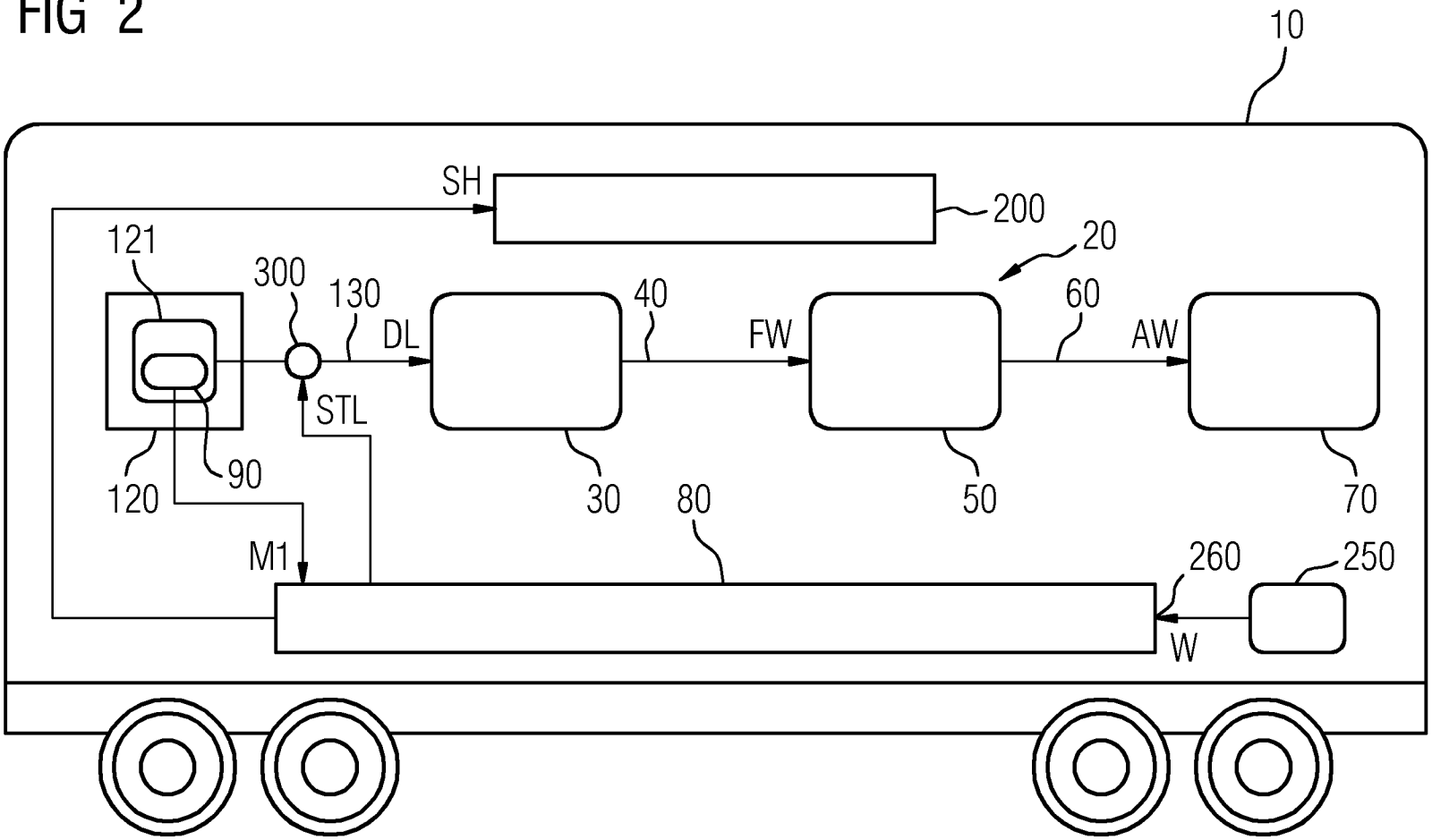
FIG. 2 shows a second exemplary embodiment of a transportation means according to the invention, whose water supply device is only monitored with respect to the compressed air resources provided by the compressed air device.

FIG. 2 shows a second exemplary embodiment of a railway vehicle 10 that is fitted with a water supply device 20. In contrast to the exemplary embodiment according to FIG. 1, monitoring of the consumption of resources is carried out by a control device 80 only in relation to the pressure in a pressure container 121 of a compressed air device 120. A pressure sensor 90 is provided in the region of the compressed air device 120 for this purpose, and for controlling the consumption of compressed air a compressed air valve 300 is provided in a compressed air line 130. Monitoring of the water levels in the fresh water tank 30 or in the collection container 70 is not carried out in the case of the exemplary embodiment according to FIG. 2.

Figure 3:
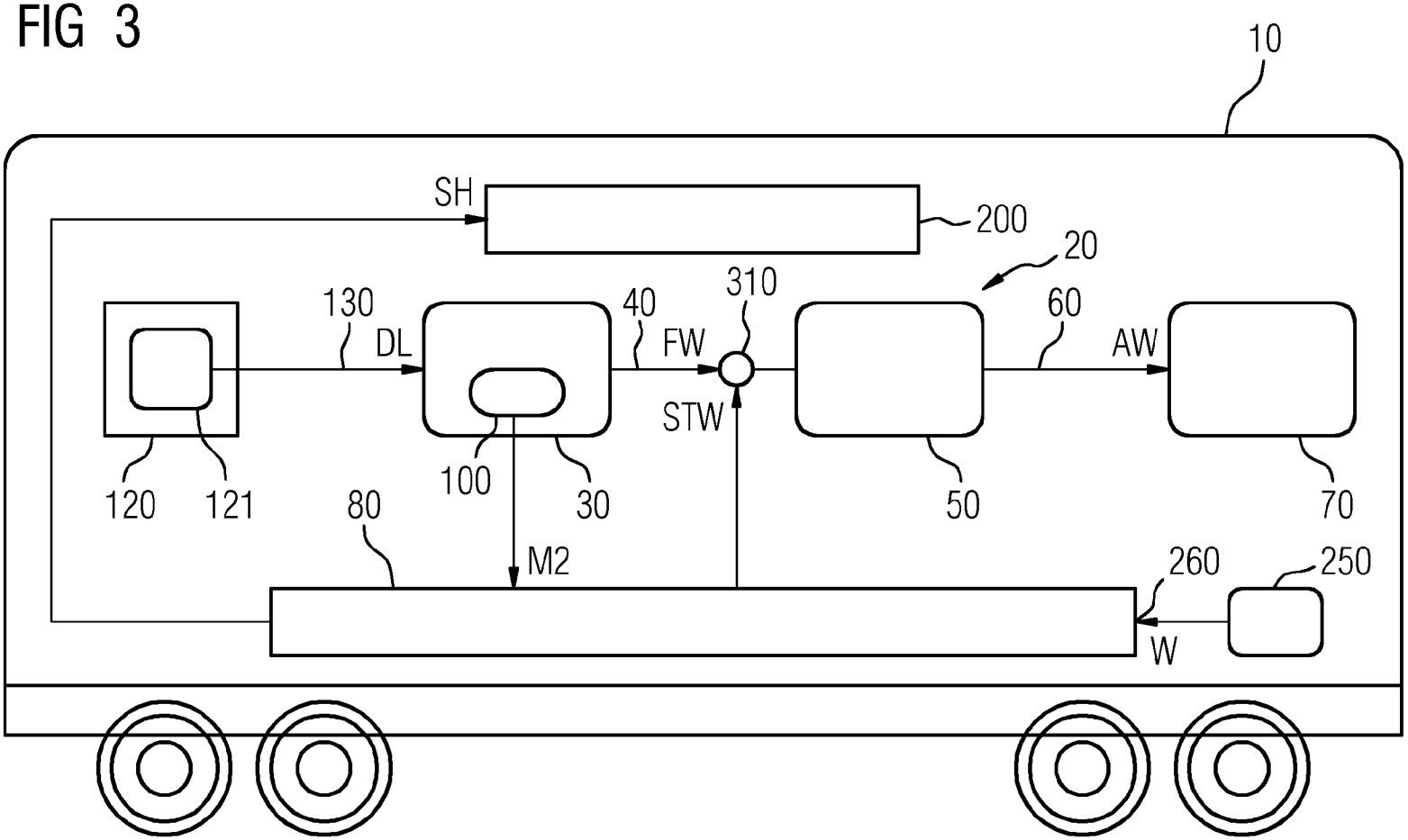
FIG. 3 shows a third exemplary embodiment of a transportation means according to the invention, with which the water supply device is only monitored with respect to the water level in the fresh water tank of the water supply device.

FIG. 3 shows a third exemplary embodiment of a railway vehicle 10 that is fitted with a water supply device 20. In the case of said exemplary embodiment, resource monitoring is carried out by means of a control device 80 only in relation to the water level in the fresh water tank 30. For this purpose a water level sensor 100 is used that transmits a corresponding water level measurement value M2 to the control device 80. By analyzing the measurement value M2 the control device 80 is able to reduce the water consumption by means of a water valve 310 if there is no longer sufficient fresh water in the fresh water tank 30.

Figure 4:
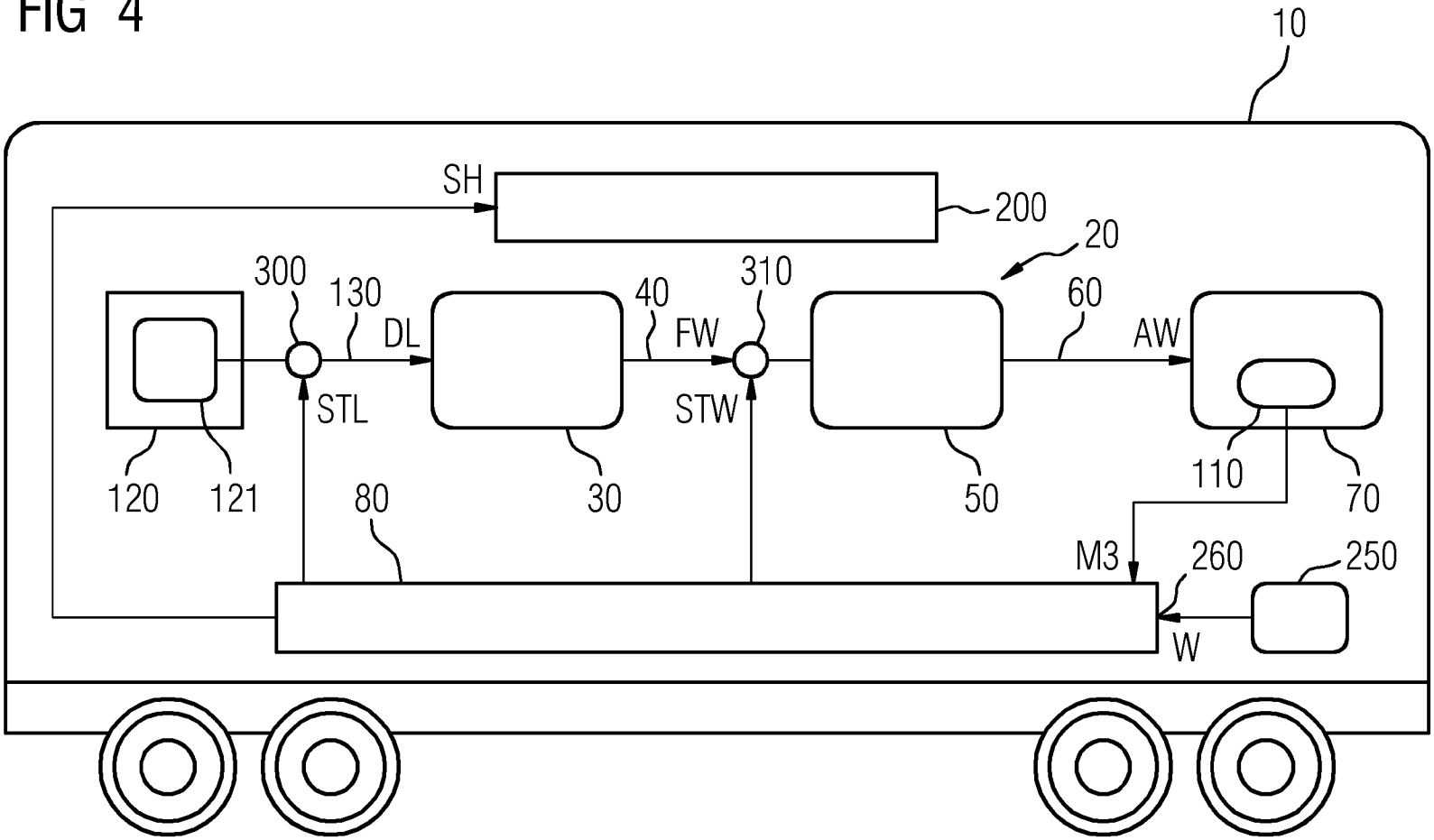
FIG. 4 shows a fourth exemplary embodiment of a transportation means according to the invention, with which only the water level in the collection container of the water supply device is monitored.

FIG. 4 shows a fourth exemplary embodiment of a railway vehicle that is fitted with a water supply device 20. In the case of said exemplary embodiment, resource monitoring is carried out by a control device 80 only in relation to the water level in the collection container 70. For this purpose the control device 80 analyses the measurement signal M3 of the water level sensor 110. If in doing so it determines that the water level in the collection container 70 has reached or already exceeded a specified maximum level, then it will reduce the water consumption of the water supply device 20 either by reducing the flow of water through the water valve 310 and/or by reducing the air pressure acting on the fresh water tank 30 by means of the compressed air valve 300.

Figure 5:
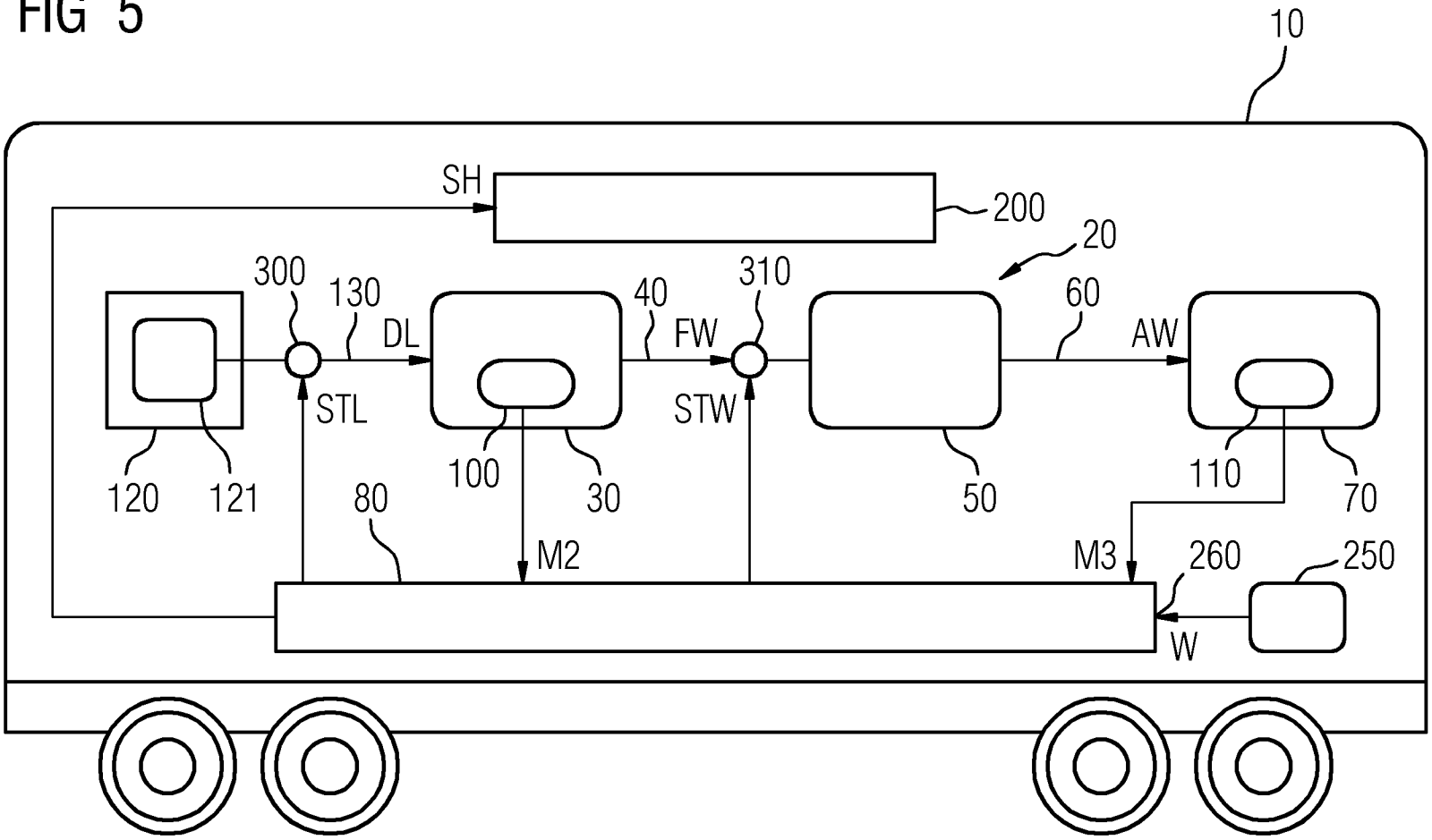
FIG. 5 shows a fifth exemplary embodiment of a transportation means according to the invention, with which the water level in the collection container and the water level in the fresh water tank are monitored for controlling the water supply device.

FIG. 5 shows an exemplary embodiment of a railway vehicle 10 with a water supply device 20, whereby a control device 80 is monitoring both the water level in the fresh water tank 30 and also in the collection container 70. For this purpose, water level sensors 100 and 110 are used, being disposed in the fresh water tank 30 and in the collection container 70.

If the control device 80 determines that the water level in the fresh water tank 30 is below a specified minimum level and/or the water level in the collection container 70 exceeds a specified maximum level, then it will reduce the water consumption of the water supply device 20 either by reducing the flow of water through the water valve 310 and/or by reducing the air pressure of the compressed air device 120 acting on the fresh water tank 30 by means of the compressed air valve 300.

Figure 6:
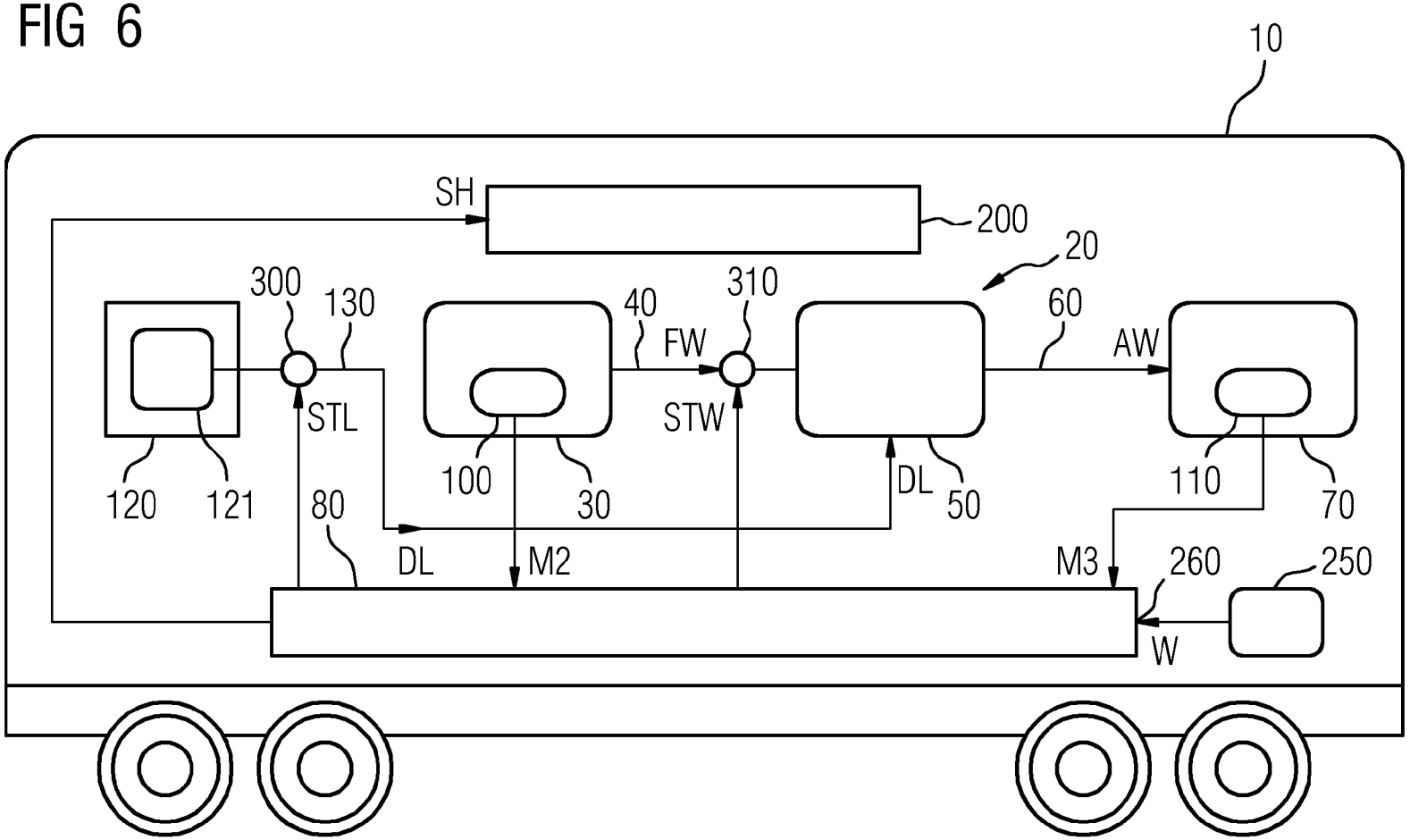
FIG. 6 shows a sixth exemplary embodiment of a transportation means according to the invention, with which compressed air is acting on a water usage device.

FIG. 6 shows an exemplary embodiment of a railway vehicle 10 with a water supply device 20, whereby the compressed air device 120 is acting on the water usage device 50 and the waste water AW from the water usage device 50 is forced into the collection container 70. Furthermore, the explanations in connection with FIGS. 1-5 also apply here.

Although the invention has been illustrated and described in detail by means of preferred exemplary embodiments, the invention is not therefore limited by the disclosed examples and other versions can be derived therefrom by the person skilled in the art without departing from the protective scope of the invention.

The invention claimed is:

1. A transportation device, comprising:

a water supply device including a fresh water tank, at least one water usage device connected to said fresh water tank, and a collection container connected to said water usage device for collection and storage of used water from said water usage device;

said water supply device including a compressed air device that produces compressed air as an operating resource, and wherein pressure generated by said compressed air device forces water from said fresh water tank towards said water usage device and/or from said water usage device towards said collection container;

said water supply device further including a control device configured to set one of at least two different operating modes by way of a control signal, the operating modes including a normal operating mode and a saving operating mode;

wherein in the saving operating mode, in comparison with the normal operating mode, compressed air is consumed to a lesser extent than in the normal operating mode; and wherein:

said water supply device includes a control valve connected to said control device, said control valve enabling a working pressure of said compressed air device acting on said fresh water tank and hence a flow of compressed air to be adjustable; and said control device is configured to cause the control valve to reduce the working pressure from a specified normal pressure to a lower saving pressure if a supply of compressed air reaches or falls below a specified minimum threshold.

2. The transportation device according to claim 1, which comprises a measurement sensor connected to said control device for monitoring a supply of resources of the at least one operating resource necessary for the operation of said water supply device, and wherein said control device changes said water supply device from the normal operating mode into the saving operating mode if the supply of resources reaches or falls below a minimum threshold.

3. The transportation device according to claim 1, wherein:

said water supply device comprises a pressure sensor connected to said control device and disposed to monitor a pressure in a pressure container of said compressed air device; and said control device is configured to reduce the working pressure acting on said fresh water tank from a specified normal pressure to a lower saving pressure if the pressure in the pressure container reaches or falls below a specified minimum pressure.

4. The transportation device according to claim 1, wherein:

said water supply device comprises a water level sensor connected to said control device for monitoring an amount of available fresh water in said fresh water tank, the fresh water being an operating resource of said water supply device; and said control device is configured to reduce a water consumption from a specified normal consumption level to a lower saving consumption level if the amount of available fresh water in said fresh water tank reaches or falls below a specified minimum value.

5. The transportation device according to claim 4, wherein:

said water supply device comprises a water valve connected to said control device and configured to affect a flow of fresh water, said valve having an opening time adjustable by said control device; and said control device is configured to reduce the opening time of said water valve per opening process from a specified normal opening time to a shorter saving opening time if the supply of fresh water reaches or falls below a specified minimum threshold.

6. The transportation device according to claim 1, wherein:

said water supply device comprises a water level sensor connected to said control device for monitoring an amount of used water in said collection container or a volume available for used water yet to be received in said collection container; and said control device is configured to reduce a water consumption from a specified normal consumption to a lower saving consumption if the amount of used water in said collection container reaches or exceeds a specified maximum value or the volume available for used water yet to be received in said collection container reaches or falls below a specified minimum value.

7. The transportation device according to claim 6, wherein:

said water supply device comprises a water valve connected to said control device and configured to affect a flow of fresh water, said valve having an opening time adjustable by said control device; and said control device is configured reduces the opening time of said water valve per opening process from a specified normal opening time to a shorter saving opening time if the amount of waste water in said collection container reaches or exceeds the specified maximum value or if the volume available for used water yet to be received in said collection container reaches or falls below the specified minimum value.

8. The transportation device according to claim 1, wherein:

the transportation device is a railway vehicle with a central vehicle control device and said water supply device is disposed in the railway vehicle;

said water supply device comprises an interface to said central vehicle control device; and said control device of said water supply device is configured to generate a control signal for setting the saving operating mode if the central vehicle control device indicates an existing or forthcoming limitation of an electrical power resource available to said water supply device by way of a warning signal received via said interface.

9. The transportation device according to claim 8, wherein:

said water supply device comprises a heating device connected to said control device; and said control device is configured to reduce a heating power of said heating device from a specified normal consumption to a lower saving consumption if the warning signal is present at said interface to said vehicle control device.

10. The transportation device according to claim 1, configured as a railway vehicle with a water supply device.

11. A method of operating a water supply device in a transportation device, the water supply device having a fresh water tank, at least one water usage device connected to the fresh water tank, and a collection container connected to the water usage device for collecting and storing used water from the water usage device, the method comprising:

producing compressed air with a compressed air device and using a pressure generated by the compressed air device to force water from the fresh water tank towards the water usage device and/or from the water usage device towards the collection container;

issuing a control signal for setting the water supply device to one of at least two different operating modes in dependence on available resources, the different operating modes including a normal operating mode and a saving operating mode; and operating the water supply device in the saving operating mode by consuming the compressed air to a lesser extent than in the normal operating mode; and selectively adjusting a flow of compressed air by way of a control valve and causing the control valve to reduce a working pressure from a specified normal pressure to a lower saving pressure if a supply of compressed air reaches or falls below a specified minimum threshold.

12. The method according to claim 11, wherein the transportation device is a railway vehicle.

* * * * *